United States Patent [19]

Shibuya et al.

[11] 4,313,802

[45] Feb. 2, 1982

[54] METHOD OF PLATING STEEL STRIP WITH NICKEL-ZINC ALLOY

[75] Inventors: Atsuyoshi Shibuya, Kyoto; Tatsuo Kurimoto, Osaka, both of Japan

[73] Assignee: Sumitomo Metal Industries, Ltd., Osaka, Japan

[21] Appl. No.: 118,962

[22] Filed: Feb. 5, 1980

[30] Foreign Application Priority Data

Feb. 15, 1979 [JP] Japan ..... 54-16927
Feb. 15, 1979 [JP] Japan ..... 54-16928
Dec. 18, 1979 [JP] Japan ..... 54-165343

[51] Int. Cl.[3] ..... C25D 3/56; C25D 5/04

[52] U.S. Cl. ..... 204/28; 204/43 Z; 204/206

[58] Field of Search ..... 204/28, 43 Z, 206, 43 T

[56] References Cited

U.S. PATENT DOCUMENTS 2,419,231 4/1947 Schantz ..... 204/43 Z X
2,844,530 7/1958 Wesley et al. ..... 204/43 T X
2,989,446 6/1961 Hammond et al. ..... 204/43 Z X
3,865,701 2/1975 Borgmann ..... 204/28
3,989,604 11/1976 Austin ..... 204/28

FOREIGN PATENT DOCUMENTS 70462 12/1969 German Democratic Rep .... 204/43 Z

OTHER PUBLICATIONS

Frederick A. Lowenheim, "Modern Electroplating", pp. 468–470, (1963).

*Primary Examiner*—G. L. Kaplan
*Attorney, Agent, or Firm*—Browdy and Neimark

[57] ABSTRACT

A method of plating steel strip with a zinc-nickel alloy in an acidic bath, comprises continuously passing the steel strip through the electrolytic plating bath under the conditions that the concentration of $Ni^{2+}$ is kept at a level of 20 g/l or more and the concentration of $Zn^{2+}$ at a level of 10 g/l or more and the molar ratio of $Ni^{2+}/Zn^{2+}$ is restricted to a range of from 1.5 to 4.0 with the speed of passage of the steel strip through the electrolyte relative to the counter-current flow of the electrolyte kept at 10–200 m/min.

17 Claims, 3 Drawing Figures

METHOD OF PLATING STEEL STRIP WITH NICKEL-ZINC ALLOY

The present invention is directed to a method of producing steel strip plated with a Ni-Zn alloy having excellent resistance to corrosion.

Zinc plating is generally used to protect a steel surface from corrosion. The effectiveness of zinc plating in preventing corrosion of steel is due to the fact that the coated zinc corrodes in preference to the substrate steel. The corrosion resistance effectiveness of the plating, therefore, depends on the amount of zinc deposited, and it is necessary to deposit a large amount of zinc in order to provide the steel surface with a coating that will give long term resistance to corrosion. However, depositing a large amount of zinc increases production cost and impairs weldability.

Heretofore, several methods have been proposed for providing a steel surface with a coating having excellent resistance to corrosion. British Pat. No. 548,184, for example, discloses a method of applying a Ni-Zn alloy coating to steel wires. The most preferred alloy composition is 11–18% Ni and the balance zinc, which results in the most effective corrosion resistance. However, it is extremely difficult to successfully apply this method to the commercial production line, since any change in process conditions, such as in plating current density and so on nevitably brings about a change in the alloy composition and fluctuation in thickness of coating. Thus, stable corrosion resistance and surface smoothness were not obtained.

Japanese Patent Disclosure No. 28533/1976 discloses the employment of a cyanide bath instead of the conventional acidic or alkaline bath as an electrolyte for plating. Though the method disclosed therein is intended particularly for plating an article (electronic devices, etc.) at a relatively low current density, change in the depositing alloy composition can be prevented to some extent. However, this method is not so effective when applied to steel strip having a large surface area to be plated and when a high current density is required to accomplish the plating with high productivity. Further, this method is inevitably accompanied by the problem of treating waste water containing cyanide ions. Therefore, there is no possibility that this method may be used for plating steel strip with a Ni-Zn alloy.

U.S. Pat. Nos. 2,419,231, 3,420,754 and 3,558,442 have also been proposed for plating steel strip with a Ni-Zn alloy. These U.S. Patents are all directed to the composition of plating bath, although they are silent about the molar ratio of $Ni^{2+}/Zn^{2+}$ of the plating bath and the feeding speed of strip through the plating bath. The molar ratio is less than 0.8 (see U.S. Pat. No. 3,420,754) on calculation. If the supply of current fluctuates slightly at such a low molar ratio, the coating does not contain enough Ni to provide satisfactory corrosion resistance and satisfactory appearance.

Thus, none of the conventional methods of plating steel strip with a Ni-Zn alloy as the surface treatment of steel strip is practicable on an industrial scale.

The main object of the present invention is to provide a method of producing steel strip plated with a Ni-Zn alloy, which is practicable on an industrial scale.

Another object of the present invention is to provide a method of producing steel strip plated with Ni-Zn alloy having uniform alloy composition and uniform thickness in spite of unavoidable fluctuations in plating conditions during operation.

The inventors of the present invention have completed this invention after extensive study and experiments with the aim in mind of providing a method for continuously electroplating steel strip with Ni-Zn alloy to provide a coating having uniform composition and uniform thickness.

The inventors found that optimization of the molar ratio of $Ni^{2+}$ to $Zn^{2+}$ in the plating bath (hereinafter sometimes referred to as "the molar ratio") and of the relative speed between the fed steel strip and the circulating electrolyte are the controlling factors in providing a uniform coating of Ni-Zn alloy deposited at a current density higher than 5 $A/dm^2$ regardless of fluctuation in plating conditions.

Therefore, the present invention resides in a method of plating steel strip with a zinc-nickel alloy which comprises continuously passing the steel strip through an electrolytic plating bath in which the concentration of $Ni^{2+}$ is kept at a level of 20 g/l or more and the concentration of $Zn^{2+}$ at a level of 10 g/l or more and simultaneously restricting the molar ratio of $Ni^{2+}/Zn^{2+}$ to a range of from 1.5 to 4.0 with the speed of passage of the steel strip through the electrolyte relative to the counter-current flow of the electrolyte kept at 10–200 m/min.

Thus, the present invention is characterized by controlling said plating conditions while carrying out the electroplating of steel strip—that is, keeping the $Ni^{2+}$ concentration at a level of 20 g/l or more, the $Zn^{2+}$ concentration at a level of 10 g/l or more and simultaneously restricting the molar ratio of $Ni^{2+}/Zn^{2+}$ to a range of 1.5–4 and the relative rate of passage of the steel strip with respect to the electrolyte at 10 m/min–200 m/min.

According to the present invention in which these plating conditions are kept within these limitations, it is possible for the first time to electroplate steel strip with Ni-Zn alloy on an industrial scale and provide a coating having uniform composition and good corrosion resistance. The resultant plated steel strip has excellent surface brightness.

Though the mechanism of the present invention is not completely understood, it is thought that it is the presence of a relatively large amount of $Ni^{2+}$ in the electrolyte of the present invention compared with that of $Zn^{2+}$, which makes it possible to provide the steel surface with a plating which has satisfactory corrosion resistance even if the steel strip is passed through the electrolyte at relatively high speed. In addition, since the strip passes through the electrolyte at rather high speed, the resulting coating has a uniform alloy composition and a uniform thickness regardless of fluctuation in some of the plating conditions.

In order to use the method of the present invention continuously for a long period of time, it is necessary to keep the plating conditions within the ranges mentioned above, so $Ni^{2+}$ ions and $Zn^{2+}$ ions must be added to the plating bath which has been depleted of these ions. However, if these ions are added in the form of sulfate or chloride, the addition of these salts results in the accumulation of corresponding anions, such as sulfate ions and chloride ions.

Thus, in another aspect, the present invention is characterized by employing any of the following means to keep the composition of the plating bath constant:

(1) An insoluble electrode is employed as an anode and the supplemental $Ni^{2+}$ ions and $Zn^{2+}$ ions are introduced to the bath in the form of a basic compound, such as zinc oxide (ZnO), basic zinc carbonate ($ZnCO_3.nZn(OH)_2$), zinc hydroxide ($Zn(OH)_2$), basic nickel carbonate ($NiCO_3.2Ni(OH)_2$), and nickel hydroxide ($Ni(OH)_2$).

Due to the employment of an insoluble electrode, oxygen gas is generated on the surface of the anodes, resulting in decreases in pH of the bath. This decrease in pH is off-set by the addition of the basic compounds mentioned abqve. The anion moieties of these compounds are converted to water or carbon dioxide, which do not change the pH of the plating bath.

(2) A soluble electrode made of nickel and a soluble electrode made of zinc are used as an anode. $Ni^{2+}$ ions and $Zn^{2+}$ ions dissolved from the electrodes into the electrolyte may compensate the consumption of these ions during the process of electroplating. In this case, as in the conventional zinc plating, it is advantageous to employ a plurality of electrolytic plating cells. Some of the cells are provided with an anode made of nickel and some are provided with an anode made of zinc, so that the bath composition may easily be controlled. The electrolyte in this case, too, is circulated through the system via a common storage tank.

(3) Alternatively, some of the electrodes are made insoluble and the other made soluble. In this case, if necessary, $Ni^{2+}$ ions and $Zn^{2+}$ ions may be supplied in the form of a basic compound.

The reasons for restricting the plating conditions to those of the present invention will be described in the following.

At a concentration of $Ni^{2+}$ of less than 20 g/l and at a concentration of $Zn^{2+}$ of less than 10 g/l, a stable plating operation is not achieved. The upper limits of the concentrations thereof are respective saturation points.

If the molar ratio of $Ni^{2+}$ to $Zn^{2+}$ is less than 1.5 and the supply of current fluctuates slightly, the coating does not contain enough Ni to provide satisfactory corrosion resistance and satisfactory appearance. On the contrary, if the molar ratio is more than 4, too much nickel is deposited, adding to the processing cost and resulting in precipitation of a Ni-phase containing Zn dissolved therein ($\alpha$-phase), which impairs the corrosion resistance of the resulting coating. Preferably, the molar ratio is 1.8–3.0.

The rate at which the steel strip is passed through the plating bath has an influence on the $Ni^{2+}/Zn^{2+}$ balance in the area adjacent to the surface of the strip passing through the plating bath. A series of experiments made by the inventors showed that if the strip moves through the electrolytic bath at a rate of less than 10 m/min, there is a change in the composition of the plating bath adjacent to the strip surface and under these conditions current density is decreased, so that too much Ni is deposited, rendering the process less economical. In addition, due to the fluctuation in plating conditions, a coating having a uniform composition cannot be obtained. Thus, in the present invention the speed at which the strip is moved through the plating bath is 10 m/min or more. On the other hand, at a rate of more than 200 m/min, Ni is not deposited sufficiently to provide a coating of uniform brightness with satisfactory resistance to corrosion. Preferably, the relative speed of the strip is up to 100 m/min.

Since the feeding rate of the steel strip is previously determined taking into consideration the size of cells, the capacity of the apparatus and other process conditions, the control of the speed is carried out by controlling the flow rate of the electrolyte through the cell. Therefore, under the usual conditions the electrolyte should be circulated through the system during the plating operation. Thus, the rate at which the steel strip passes through the plating bath is defined as the speed of the steel strip relative to the counter-current flow of electrolyte.

The temperature of the plating bath is preferably 40°–70° C. At a lower temperature the deposition of nickel is not sufficient to give a satisfactory plating. On the other hand, at a higher temperature, the deposition of nickel increases too much and the evaporation of the electrolyte is not negligible making the operation less economical.

It is desirable to keep the pH of the plating bath at a ph of 1.0–4.5. As the pH is lowered, the number of bubbles of hydrogen gas formed in the plating bath increases, leaving traces of the bubbles on the plated surface with concurrent decrease in current efficiency. An excessively high pH sometimes give the plating a dark appearance.

The current density is higher than 5 $A/dm^2$, preferably 5–40 $A/dm^2$.

The present invention will be further described in conjunction with the accompanying drawings, in which.

Figure 1:
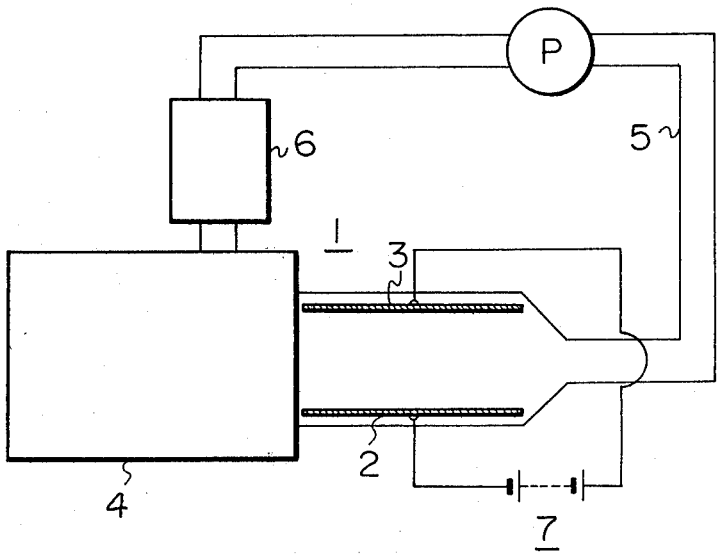
FIG. 1 is a schematic view showing a testing apparatus with which the relations among a variety of plating conditions were determined.

Now referring to FIG. 1, a testing apparatus 1 comprises a plating cell, an anode 3 placed within the cell, a tank 4 and an electrolyte contained in the tank. The electrolyte is circulated through the system via a conduit 5. The flow of the electrolyte is recorded with a flow meter 6 provided in the conduit. A steel strip 2 to be plated with Ni-Zn alloy is placed apart from and facing anode 3 within the cell. The anode is connected to a direct current source 7. The steel strip is also connected to the direct current source and acts as a cathode. The composition of the plating bath is controlled by adding basic compounds to the electrolyte in the tank 4.

Figure 3:
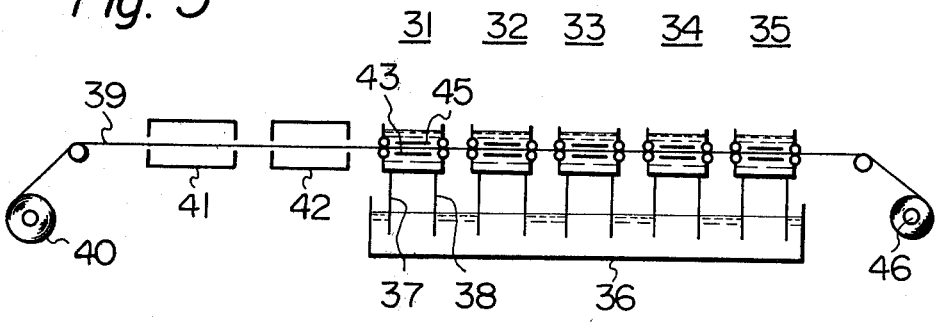
FIG. 3 is a schematic view showing a production line utilizing a plurality of electrolytic plating cells, to which the method of the present invention is applied.

The apparatus shown in FIG. 3 comprises five plating cells 31, 32, 33, 34 and 35, which are placed in series. The electrolyte contained in a common storage tank 36 is circulated through each of the cells via conduits 37 and 38. The steel strip 39 is uncoiled from an uncoiler 40 and is passed through an alkaline degreasing cell 41 and then a pickling cell 42. The thus pretreated steel strip is continuously supplied through a series of electrolytic baths, the composition of which is controlled in accordance with the present invention. In each of the cells, a pair of anodes 43 and 45 is provided through which the strip as cathode is passed. After completion of electroplating, the steel strip is coiled by a coiler 46. To keep FIG. 3 more clear, an electric source is not shown.

If the anodes used are of the insoluble type, basic compounds of nickel and zinc are added to the electrolyte in tank 36 during the plating operation so as to control the bath composition. If the anodes used are of the soluble type, the ratio of the number of nickel anode to that of zinc anode is 1:1 to 1:4 under the usual conditions.

EXAMPLE 1

A testing apparatus as shown in FIG. 1 was used to carry out a series of experiments in order to determine the influence of the amount of $Ni^{2+}$ ions and $Zn^{2+}$ ions in the plating bath on steels trip plating. By varying the concentrations of $Ni^{2+}$ ions and $Zn^{2+}$ ions in the bath the molar ratio was changed. The appearance and corrosion resistance of the resulting coating were measured with respect to the molar ratio.

The salts used were nickel sulfate and zinc sulfate. As a supporting electrolyte sodium sulfate was added to the plating bath in an amount of 70 g/l. The temperature of the bath was maintained at 50° C. and the pH was adjusted to between 2.0 and 2.3. As an anode, an insoluble electrode made of lead was used and as specimen substrate there was used a steel strip 0.4 mm thick×50 mm wide×300 mm long. The moving speed of the steel strip relative to the counter-current flow of the circulating electrolyte was 10 m/min. The current density was 20 A/dm$^2$. The coating weight was 20 g/m$^2$ or more.

Figure 2:
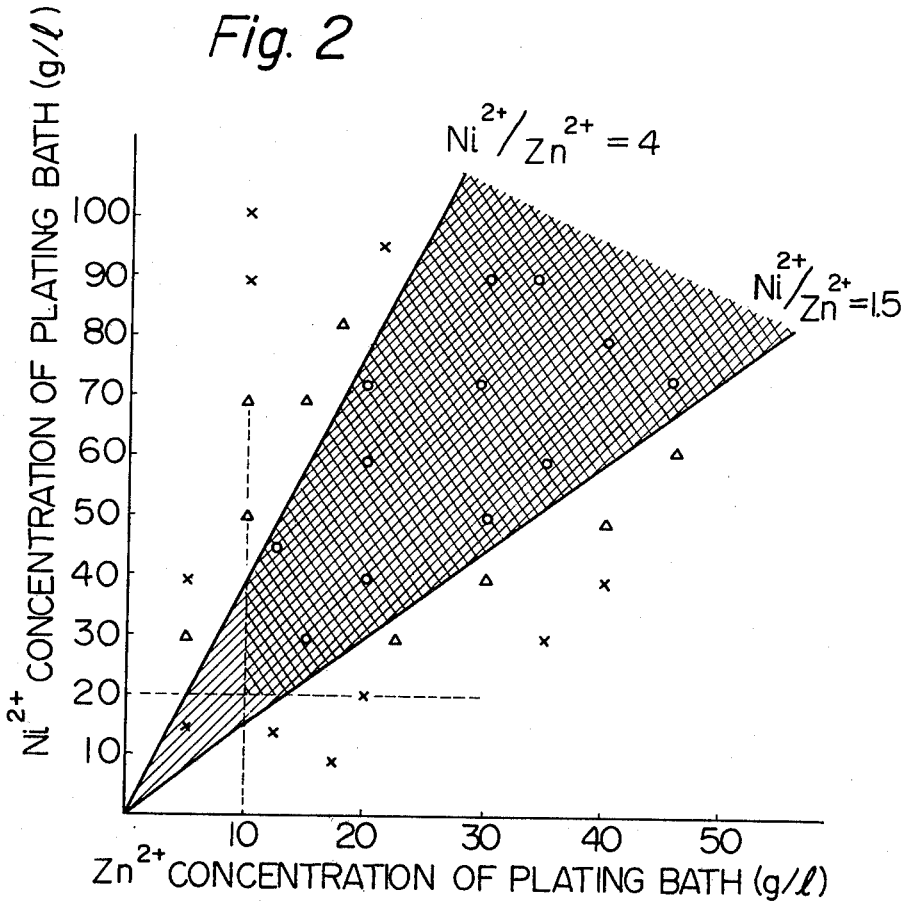
FIG. 2 is a graph showing the relation between the molar ratio of $Ni^{2+}/Zn^{2+}$ in the plating bath and the results of plating.

The results of the series of experiments are summarized in the graph shown in FIG. 2, in which the symbol "o" indicates that the resulting coating had a good appearance and a good resistance to corrosion, "Δ" bad appearance but good resistance to corrosion, and "x" bad appearance and poor resistance to corrosion.

The "good appearance" means a bright surface with a silver-white appearance, and the "good resistance to corrosion" means that it took more than 120 hours until red rust was generated in the salt spray test.

As can be seen from the graph shown in FIG. 2, satisfactory results were obtained when the molar ratio fell within the range of from 1.5 to 4.0. In other words, a Ni-Zn alloy coating having good resistance to corrosion as well as good appearance is obtained only when the molar ratio of $Ni^{2+}/Zn^{2+}$ is adjusted to be within the range of 1.5 to 4.0.

EXAMPLE 2

In this example, a cold rolled steel strip (0.8 mm thick×300 mm wide) was continuously plated using a horizontal continuous plating line having two electrolytic plating cells. As an anode an insoluble electrode made of lead containing 1% Ag was used. During the process of plating, nickel was supplied in the form of basic nickel carbonate at a rate of 0.67 kg/hr and zinc was supplied in the form of zinc oxide in a rate of 2.3 kg/hr.

The other plating conditions were as given below.

(1) Plating bath:

An electroplating bath was prepared by using nickel sulfate ($NiSO_4.6H_2O$) in an amount of 265 g/l and zinc sulfate ($ZnSO_4.7H_2O$) in an amount of 145 g/l. The molar ratio of $Ni^{2+}/Zn^{2+}$ was 1.99 (concentration of $Ni^{2+}$ was 59.1 g/l and $Zn^{2+}$ was 33.1 g/l) in the initial electrolyte solution. Sodium sulfate ($Na_2SO_4$) in an amount of 75 g/l was also added thereto as a supporting electrolyte and the pH of the plating bath was adjusted to 2.1–2.5 with sulfuric acid ($H_2SO_4$). The temperature of the bath was maintained at 50°–55° C.

(2) Current density:

20 A/dm$^2$ (3) Electrolyte circulating rate:

The electrolyte was fed to the plating cells countercurrently to the strip and was circulated through the system at a rate of 11–14 m/min.

(4) Steel strip feeding rate:

The steel strip was passed through the electrolytic plating cells at a rate of 4 m/min.

(5) Relative speed between the strip and the electrolyte:

The speed of the steel strip relative to the circulating electrolyte was 15–18 m/min calculated on the basis of the data shown in (4) and (3) above.

(6) Coating weight:

The amount of deposition was 20 g/m$^2$.

After completion of the plating process, the coated surface was examined over the whole length of the strip. It was found that there was no dull portion and the coating had a bright surface. The results were satisfactory. Examination of alloy composition revealed that the nickel content was in the range of 12.8 to 13.1%, which falls within the target range of from 9 to 20%. The salt spray test revealed that there was no red rust until 192 hours elapsed.

The composition of the plating bath was maintained substantially the same as the initial one by supplying basic nickel carbonate and zinc oxide. The fluctuations in plating bath conditions were recorded as follows.

$Ni^{2+}$: 56.5–61.5 g/l
$Zn^{2+}$: 28.2–34.0 g/l
$Ni^{2+}/Zn^{2+}$ molar ratio: 1.8–2.3
pH: 1.8–2.5

EXAMPLE 3

In this example, steel strip (914 mm wide×0.8 mm thick) was plated using a continuous plating line shown in FIG. 3, in which the anodes of the first, second, fourth and fifth cells were made of pure zinc and the anode of the third cell was made of nickel.

The plating conditions were as summarized below.

(1) Plating bath:

$ZnSO_4$: 80 g/l ($Zn^{2+}$: 32.4 g/l)
$NiCl_2$: 200 g/l ($Ni^{2+}$: 90.6 g/l)
$NH_4Cl$: 30 g/l
$Ni^{2+}/Zn^{2+}$ molar ratio: 3.11
pH: 2.2
bath temperature: 50° C.

(2) Current density: 20 A/dm$^2$ (3) Relative speed of strip: 20 m/min (4) Coating weight: 20 g/m$^2$ Since consumable electrodes were used, the composition of the plating bath was maintained substantially the same as the initial one even after 40 hours. The surface of the resulting coating showed a bright appearance. Analysis showed the nickel content of the coating to be 13.2–13.8%. Thus, the fluctuation in alloy composition was very little and the alloy composition can be deemed substantially the same throughout the whole length of the plated strip. The salt spray test revealed that there was no red rust even after spraying for 192–240 hours.

What is claimed is:

1. A method of plating steel strip at a current density higher than 5 A/dm$^2$ with a zinc-nickel alloy which comprises continuously passing the steel strip at a predetermined feeding rate through an electrolyte plating bath at a pH of 1.0–4.5 and a temperature of 40°–70° C. in which the concentration of $Ni^{2+}$ is maintained at a level of 20 g/l or more and the concentration of $Zn^{2+}$ at a level of 10 g/l or more and simultaneously the molar ratio of $Ni^{2+}/Zn^{2+}$ is restricted to a range from 1.5 to 4.0, with the relative speed of passage of the steel strip with respect to the electrolyte being maintained at 10–200 m/min. by flowing the electrolyte counter-current to the direction of travel of the steel strip.

2. The method defined in claim 1, in which the current density is 5–40 A/dm$^2$.

3. The method defined in claim 1, in which the relative speed of the steel strip passing through the electrolytic plating bath is up to 100 m/min.

4. The method defined in claim 1, in which the zinc-nickel alloy contains nickel in the range of 9–20%.

5. The method defined in claim 1, in which the molar ratio of $Ni^{2+}/Zn^{2+}$ is restricted to a range of 1.8 to 3.0.

6. A method of plating steel strip at a current density higher than 5 A/dm$^2$ with a zinc-nickel alloy which comprises continuously passing the steel strip at a predetermined feeding rate through an electrolytic plating bath at a pH of 1.0–4.5 and a temperature of 40°–70° C. provided with at least one soluble anode made of nickel and with at least one soluble anode made of zinc, the concentration of $Ni^{2+}$ ions in the electrolyte being maintained at a level of 20 g/l or more and the concentration of $Zn^{2+}$ ions at a level of 10 g/l or more and simultaneously the molar ratio of $Ni^{2+}/Zn^{2+}$ being restricted to a range of from 1.5–4.0, with the speed of passage of the steel strip relative to the electrolyte being maintained at 10–200 m/min. by flowing the electrolyte counter-current to the direction of travel of the steel strip.

7. The method defined in claim 6, in which the current density is 5–40 A/dm$^2$.

8. The method defined in claim 6, in which the relative speed of the steel strip passing through the electrolytic bath is up to 100 m/min.

9. The method defined in claim 6, in which the ratio of the number of nickel anode to that of zinc anode is 1:1 to 1:4.

10. The method defined in claim 6, in which the zinc-nickel alloy contains nickel in the range of 9–20%.

11. The method defined in claim 6, in which the molar ratio of $Ni^{2+}/Zn^{2+}$ is restricted to a range of 1.8 to 3.0.

12. A method of plating steel strip at a current density higher than 5 A/dm$^2$ with a zinc-nickel alloy which comprises continuously passing the steel strip at a predetermined feeding rate through an electrolyte plating bath at a pH of 1.0–4.5 and a temperature of 40°–70° C. provided with at least one insoluble anode, the concentration of $Ni^{2+}$ ions in the electrolyte being maintained at a level of 20 g/l or more, the concentration of $Zn^{2+}$ ions at a level of 10 g/l or more and simultaneously the molar ratio of $Ni^{2+}/Zn^{2+}$ being restricted to a range of 1.5–4.0, with the speed of the steel strip relative to the counter-current flow of the electrolyte being maintained at a rate of 10–200 m/min. by adjusting the counter-current flow rate of the electrolyte and supplying additional $Ni^{2+}$ and $Zn^{2+}$ ions to the electrolyte in the form of a basic compound thereof during operation.

13. The method defined in claim 12, in which the basic compound of nickel is selected from the group consisting of basic nickel carbonate, nickel oxide and nickel hydroxide, and the basic compound of zinc is selected from the group consisting of basic zinc carbonate, zinc oxide and zinc hydroxide.

14. The method defined in claim 12, in which the current density is 5–40 A/dm$^2$.

15. The method defined in claim 12, in which the relative speed of the steel strip passing through the plating bath is up to 100 m/min.

16. The method defined in claim 12, in which the zinc-nickel alloy contains nickel in the range of 9–20%.

17. The method defined in claim 12, in which the molar ratio of $Ni^{2+}/Zn^{2+}$ is restricted to a range of 1.8 to 3.0.

* * * * *